United States Patent [19]

Nakanishi et al.

[11] Patent Number: 4,642,523

[45] Date of Patent: Feb. 10, 1987

[54] PRECISION TUNABLE RESONANT MICROWAVE CAVITY

[75] Inventors: Shigeo Nakanishi, Berea; Frank S. Calco, Olmsted Falls; August R. Scarpelli, Litchfield, all of Ohio

[73] Assignee: The United States of America as represented by the Administrator of the National Aeronautics and Space Administration, Washington, D.C.

[21] Appl. No.: 700,255

[22] Filed: Feb. 11, 1985

[51] Int. Cl.[4] ..... H01J 27/00

[52] U.S. Cl. ..... 315/111.81; 250/423 R

[58] Field of Search ..... 250/423 R; 315/5.47, 315/5.51, 5.52, 111.81

[56] References Cited

U.S. PATENT DOCUMENTS

| | | | |
|---|---|---|---|
| 2,410,109 | 10/1946 | Schelleng | 315/5.51 |
| 2,496,887 | 2/1950 | Nelson | 315/5.51 |
| 2,853,647 | 9/1958 | Litton | 315/5.52 |
| 3,297,908 | 1/1967 | Lundstrom | 315/5.47 |
| 3,300,679 | 1/1967 | Brown | 315/5.47 |
| 4,507,588 | 3/1985 | Asmussen et al. | 250/423 R |

*Primary Examiner*—Bruce C. Anderson

*Attorney, Agent, or Firm*—James A. Mackin; John R. Manning

[57] ABSTRACT

A coaxial probe extends into a microwave cavity through a tube. One end of the tube is retained in a spherical joint attached in the cavity wall. This allows the coaxial probe to be pivotally rotated. The coaxial probe is slideable within the tube thus allowing the probe to be extended toward or retracted from the center of the cavity.

A tunable wall in the cavity is precisely positioned by a plurality of threaded rods extending through threaded bushings which are geared together. Thus, rotation of one of the bushings causes rotation of the other bushings simultaneously whereby the tuning wall is accurately positioned. Means are provided for moving the tube through which the coaxial probe extends in both a side to side and back and forth motion.

8 Claims, 2 Drawing Figures

PRECISION TUNABLE RESONANT MICROWAVE CAVITY

ORIGIN OF THE INVENTION

This invention was made by employees of the U.S. Government and may be manufactured or used by the Government without the payment of any royalties thereon or therefor.

TECHNICAL FIELD

This invention relates to electrostatic or ion thruster engines and, or particularly, to a tunable microwave cavity capable of ionizing a vapor which serves as a source of ions.

In ion or electrostatic thrusters for use in outerspace, thrust is obtained by ejecting ions from the thruster. These ions are obtained from a plasma which is an ionized gas or vapor of a metal such as cesium or mercury, for example.

To ionize the gasor vapor, methods such as direct current cathode discharges, radio frequency (R.F.) induction and microwave resonance in a cavity have been used to generate a gaseous plasma discharge from which ions are extracted to produce an ion beam for thrust. All of these approaches have certain disadvantages. Where the DC discharge method is utilized to generate a plasma, a cathode which is heated to emit electrons is subject to sputter erosion and chemical deterioration. Over a period of time, the R.F. induction method produces changes in operating characteristics due to sputtered film deposits of conductive material on components of the thruster.

In the microwave resonance tunable cavity method R.F. energy is injected into the cavity and produces a plasma in a vapor-containing cell at one end of the cavity. This is an electrodeless discharge which avoids the problems of the D.C. cathode discharge and R.F. induction methods. However, to tune the microwave cavity to resonance is extremely difficult because precise positioning of an R.F. coupling tip within the cavity is required. This positioning depends on other factors as for example the dimensions of the cavity as well as the type and amount of vapor required.

PRIOR ART

U.S. Pat. No. 3,297,908 to Lundstrom discloses a Klystron transmitter tube including a capacitive pendulum tuner which extends through the Klystron vacuum envelope. The pendulum tuner is pivotal about a single axis.

U.S. Pat. No. 2,630,488 to Clogston discloses a cavity resonator including a tuning tube geared to an electric motor. The tuning tube is a rotatable resonant ring which serves to tune an oscillator supplying R.F. energy to the cavity.

U.S. Pat. No. 3,428,921 to Hargis discloses a wave guide coupling structure including a phase shifter attached to a bridging member outside of the wave guide. The bridging member is positioned by means of a rack and a pinion gear.

U.S. Pat. No. 2,439,388 to Hansen discloses a tunable R.F. cavity in which a moveable end wall is attached to a micrometer positioner.

U.S. Pat. No. 3,390,300 to Mack and U.S. Pat. No. 3,516,014 to Hines et al are directed to Klystron, high frequency electron discharge devices employing below cut-off wave guide leaky wall H-field tuners. Tuning is accomplished by a threaded member which can be advanced or withdrawn from the cavity.

DISCLOSURE OF THE INVENTION

In accordance with the present invention, an R.F. coupling tip of an R.F. probe may be positioned at any point within an imaginary conical envelope to provide maximum ionization of a plasma. The cavity has a tuning wall which also may be precisely positioned for maximum transfer of R.F. energy to the plasma.

The R.F. probe is slidably mounted in a tube one end of which is retained by a spherical joint in the wall of the cavity. The probe may be axially moved within the tube either manually or automatically while the tube may be pivoted in the spherical joint to position the R.F. coupling tip as required within the cavity.

BRIEF DESCRIPTION OF THE DRAWINGS

The details of the invention will be described in connection with the accompanying drawings in which.

DETAILED DESCRIPTION OF THE INVENTION

Figure 1:
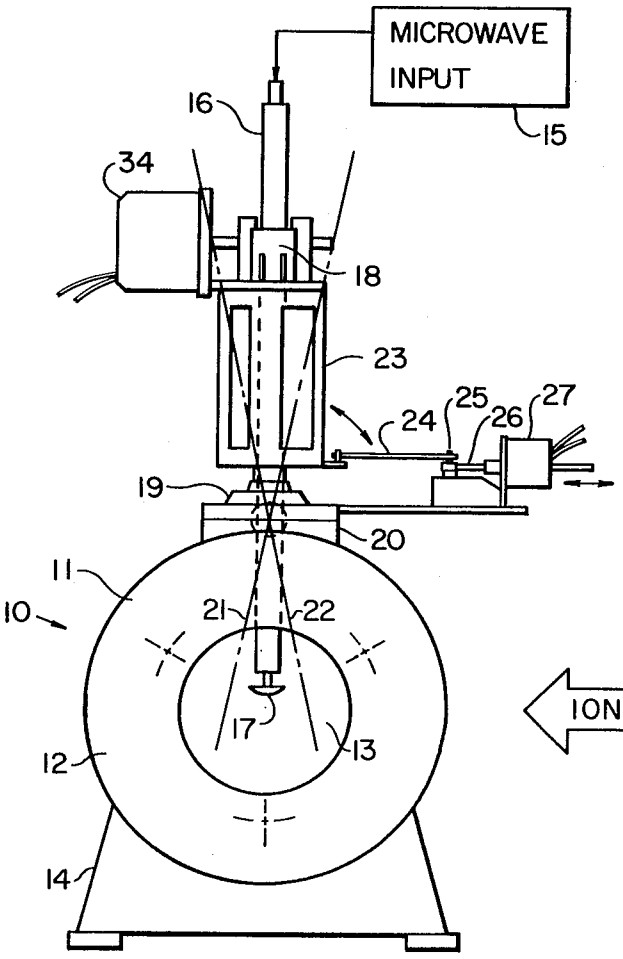
FIG. 1 is a pictorial end view of a tunable microwave cavity embodying the invention.

Referring now to FIG. 1, there is shown a cylindrical microwave cavity 10 formed by a cylindrical wall 11 and having a first end wall 12. A quartz capsule 13 containing an ionizable gas is mounted in the end wall of 12. For ion engines, cesium, mercury, and noble gases are the preferred propellants. As means of support for the microwave cavity 10, there is attached thereto a suitable support platform 14.

To provide microwave energy to the microwave cavity 10 there is provided a microwave input source 15 which directs microwave energy through a coaxial probe 16 to a coupling tip 17. The coaxial probe 16 is slideably disposed in a tube 18 one end of which is retained in a spherical joint 19 carried in a support plate 20 which is attached to the cylindrical wall 11 of the microwave cavity 10. Because the coaxial probe is slideably mounted in tube 18, the coupling tip 17 can be extended toward or retracted from any point in an imaginary cone defined by the lines 21 and 22.

To the end that tube 18 may be pivoted back and forth longitudinally with respect to cavity 10 as well as tranversally from a remote location, a cage member 23 is disposed outwardly of tube 18 and is attached by a link 24 through a nut 25 through which extends a threaded rod 26. Threaded rod 26 may be translated to pivot the cage 23 from side to side transverse to the cavity 10. Preferably, threaded rod 26 is translated by a reversible electric motor 27 controlled from a remote location.

To pivot the cage 23 back and forth longitudinally, it is connected by a link 28 to a threaded nut 29 through which extends a threaded rod 30.

The threaded rod 30 may be translated manually but is preferably driven by a second electric motor 31 whose direction of rotation is controlled from a remote location. Thus it will be seen, that by translating the threaded rod 26 of FIG. 1 and the threaded rod 30 of FIG. 2 the coaxial probe 16 can be angled such that it is within the conical envelope of lines 21, 22.

Figure 2:
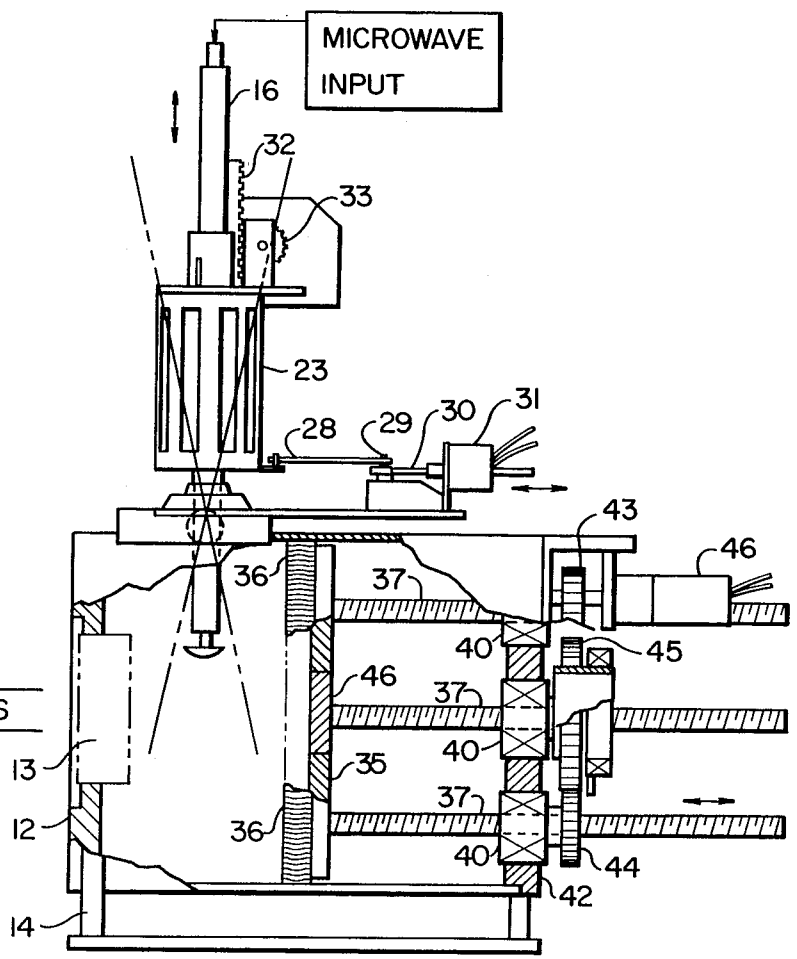
FIG. 2 is a pictorial side view of the tunable cavity partially cut away to show interior components.

In order to precisely position the coupling tip 17, there is shown in FIG. 2 a toothed member 32 attached to coaxial probe 16 and meshed with a pinion gear 33. Gear 33 may be rotated as desired to radially position coupling tip 17. Preferably, gear 33 is driven by a reversible electric motor 34 controlled from a remote location.

Depending on the wavelength of the microwave energy coupled into cavity 10, the dimensions of the cavity have to be adjusted to establish resonance. To this end, there is provided a tuning wall 35 slideably disposed for longitudal movement in the cylinder 11 as shown in FIG. 2. Tuning wall 35 is provided with a plurality of spring contacts 36 to make good contact with the interior wall of the cylinder 11.

It is essential that the tuning wall 35 be maintained parallel to the first end wall 12 as it is moved. This is advantageously accomplished by three threaded rods 37 which are fixedly attached to wall 35 and extend through respective rotatable threaded bushings 40 located in a second end wall 42 of the cylinder 11. By rotating the three threaded bushings in unison the position of the tuning wall 35 can be changed while maintaining its parallelism with the first end wall 11.

By means of a drive gear 43, and a central gear 45 meshed with three cluster gears 44 attached to the three threaded bushings 40, respectively, all three threaded bushings are enabled to rotate in unison, thus driving the three threaded rods such as 37 axially in unison. By incorporating the electric motor 46, the tuning wall 35 may be positioned as desired from a remote location.

While only three threaded rods 37 are shown in FIG. 2, a greater number of threaded rods may be used with three being the preferred number.

If three threaded rods are used, as preferred, they will be at equal distances from the centers of tuning wall 35 and end wall 42 and will also be equally spaced circumferentially.

The foregoing described apparatus enables the coupling tip 17 to be precisely precisioned so that maximum microwave energy will be coupled to an ionizable gas in a microwave resonant cavity. This condition is obtained by the interrelationship of the coupling tip 17 and the tuning wall 35.

As shown in FIG. 2, the tuning wall 35 is provided with a removable plug 46. By removing the plug 46, a quartz tube 13 of suitable diameter may be substituted if desired so that the tube extends from the first cavity wall 12 through the second cavity end wall 42 and beyond. Thus the quartz tube 13 may extend through the opening provided in the tuning wall 35 by the removal of plug 46.

It will be understood that those skilled in the art to which the above-described invention pertains make changes and modifications to the invention without departing from its spirit and scope, as set forth in the claims appended hereto.

We claim:

1. Apparatus for ions impressing microwave energy on an ionizable gas to produce a plasma which serves as a source of ions, said apparatus comprising:

a cylindrical metal chamber having first and second endwalls;

a capsule of ionizable vapor disposed in said first endwall;

a tuning wall slidably disposed in said chamber between said endwalls;

a plurality of threaded rods attached to said tuning wall and extending through said second endwall in threaded engagement with respective rotatable bushings in said second wall;

a plurality of gears with each gear carried on respective one of each of said plurality of threaded rods and meshing with a common gear rotatably supported on said second endwall;

common gear driving means for rotating said common gear and, consequently, said rotatable bushings to position said tuning wall;

a spherical pivot joint disposed in the cylindrical wall of said cylindrical chamber;

a tube having one end retained in said spherical joint and extending outwardly from said chamber;

a coaxial probe having a coupling tip position in said chamber between said first endwall and said tuning wall and slidably extending through said tube for connection to a source of microwave energy;

means for slidably positioning said coaxial probe in said tube whereby said coupling tip is moveable toward and away from the center axis of said cylindrical metal chamber, said tube being pivotable in said spherical pivot joint within an imaginary cone, the apex of which is at the center of the spherical joint thereby allowing positioning of said coupling tip at a desired location.

2. The apparatus of claim 1 including first means for pivoting said tube in a direction parallel to said cylindrical chamber and second means for pivoting said tube in a direction perpendicular to said cylindrical chamber whereby said coupling tip can be positioned anywhere within an imaginary cone, the apex of which is at the center of said spherical joint.

3. The apparatus of claim 1 wherein three threaded rods are provided.

4. The apparatus of claim 1 and wherein said driving means is an electric motor driveably connected to one of said threaded bushings.

5. The apparatus of claim 2 wherein said first means comprises a link connected between said tube and a nut carried on a threaded rod driven by an electric motors, said link and said threaded rod being generally parallel to said cylindrical chamber and wherein said second means comprises a link connected between said tube and a nut carried on a threaded rod driven by an electric motor, said link and said threaded rod being oriented generally perpendicular to said cylindrical chamber.

6. The apparatus of claim 1 wherein said tuning wall includes an aperture and wherein said capsule of ionizable vapor is a quartz tube extending from said first wall through the aperture in said tuning wall.

7. The apparatus of claim 6 wherein said quartz tube extends beyond second wall and is supported therein.

8. The apparatus of claim 1 wherein said ionizable vapor is selected from the group consisting of mercury vapor and cesium vapor.

* * * * *